US006883473B2

(12) United States Patent
Wondergem

(10) Patent No.: US 6,883,473 B2
(45) Date of Patent: Apr. 26, 2005

(54) RADIAL MOTOR/PUMP

(76) Inventor: Anthony Leonardus Wondergem, 9 Cootharaba Road, Helensvale, Gold Coast, Queensland (AU)

( * ) Notice: Subject to any disclaimer, the term of this patent is extended or adjusted under 35 U.S.C. 154(b) by 0 days.

(21) Appl. No.: 10/216,673

(22) Filed: Aug. 12, 2002

(65) Prior Publication Data

US 2004/0216703 A1 Nov. 4, 2004

Related U.S. Application Data

(63) Continuation of application No. 09/554,252, filed as application No. PCT/NZ98/00159 on Nov. 5, 1998, now abandoned.

(30) Foreign Application Priority Data

Nov. 12, 1997 (NZ) ..... 329166

(51) Int. Cl.[7] ..... F02B 57/00
(52) U.S. Cl. ..... 123/44 D; 123/223
(58) Field of Search ..... 123/44 D, 223, 123/227

(56) References Cited

U.S. PATENT DOCUMENTS

| | | | | | |
|---|---|---|---|---|---|
| 2,242,231 | A | * | 5/1941 | Denis | 123/44 D |
| 3,721,218 | A | * | 3/1973 | Null | 123/227 |
| 3,921,602 | A | * | 11/1975 | Froumajou | 123/44 D |
| 3,971,349 | A | * | 7/1976 | Froumajou | 123/44 D |
| 4,010,719 | A | * | 3/1977 | Lappa | 123/44 C |
| 4,688,531 | A | * | 8/1987 | Aase | 123/227 |

FOREIGN PATENT DOCUMENTS

WO 93/19284 * 9/1993

* cited by examiner

*Primary Examiner*—Hoang Nguyen
(74) *Attorney, Agent, or Firm*—Jacobson Holman PLLC

(57) ABSTRACT

A radial motor or pump has a stator inside which a rotor rotates. The stator carries one or more radial cylinders in each of which a piston is slidable. The end of each cylinder or a ring slidable therein bears against and is a sealing rubbing fit with the internal surface of the stator. The pistons are connected as by connecting rods to a crank pin of a crankshaft. Gears interconnect the stator, rotor and crankshaft to cause the rotor and crankshaft to rotate at the same speed but in opposite directions.

24 Claims, 5 Drawing Sheets

43
48
49
44
47
46
45

10
15
40
42
41
30
43
22
24
12

RADIAL MOTOR/PUMP

This is a Continuation of application Ser. No. 09/554,252 filed Aug. 14, 2000 now abandoned which in turn is a nationalization of PCT/NZ98/00159 filed Nov. 5, 1998.

FIELD OF THE INVENTION

This invention relates to radial rotary fluid pressure machines of the kind in which operation is effected by reciprocation of at least one piston in a co-acting cylinder.

In various embodiments, such machines may be used, for example, as internal combustion engines working on the 2-stroke or 4-stroke cycles, pumps for liquids, gas compressors or motors operated by pressurised liquid, gas or vapour.

STATEMENT OF THE INVENTION

According to one aspect of the present invention there is provided a radial rotary fluid pressure machine including a stator, a first surface formed on the stator as a surface of revolution about a first axis, a rotor, a second surface formed on part of the rotor as a surface of revolution about the first axis, the first and second surfaces being mounted for relative sliding rotation therebetween, characterised by a working cylinder formed in the rotor substantially radial to the first axis, a piston slidable axially in the cylinder and being a sliding fit therein, a drive shaft, coupling means interconnecting the piston and the drive shaft, the coupling means causing reciprocation of the piston in the cylinder to rotate the drive shaft or rotation of the drive shaft to cause reciprocation of the piston in the cylinder, a port formed in the stator through said first surface, at a predetermined circumferential location in the stator, through which port fluid may pass to or from the cylinder, and drive means interconnecting the rotor and the drive shaft, the drive means being arranged to rotate the rotor and the drive shaft relative to the stator at predetermined speeds and directions of rotation.

Conveniently, the coupling means comprises a crank connected rotatively to the drive shaft and a connecting rod pivoted to the piston and a pin of the crank.

The stator may be external of the rotor or it may be internal of the rotor.

Preferably, said first and second surfaces are right cylinders co-axial about said first axis.

The machine may include first and second of said ports, through which fluid may be respectively admitted to and expelled from said cylinder.

A preferred use of the machine is as an internal combustion engine, in which case it conveniently includes a first and second of said ports spaced circumferentially around the stator, one port being adapted to admit air or air/fuel mixture to the cylinder and the other port being an exhaust port from the cylinder.

Advantageously, the machine includes a spark plug or fuel injector held in the stator and exposed to said cylinder at a predetermined circumferential position of the rotor.

The machine may operate on the two stroke or the four-stroke cycle, in which case said drive means is arranged to rotate the drive shaft at a speed relative to the stator equal to the speed of rotation of the rotor relative to the stator, with the drive shaft and the rotor rotating in opposite directions relative to the stator.

Conveniently, the drive means interconnecting the rotor and the drive shaft includes a toothed gear train adapted to drive the drive shaft and the rotor relative to the stator at the same rotational speeds but in opposite directions.

Sealing between the rotor and the stator may be provided by a pair of circumferential sealing rings located in grooves in the rotor or the stator, the rings being on opposite sides axially of the cylinder.

Further sealing may be provided by a plurality of sealing strips located within said first surface to bear against the second surface and spaced circumferentially, each strip extending from one of said sealing rings to the other.

There may be a plurality of said cylinders and of said co-acting pistons disposed circumferentially around the rotor.

The machine may be adapted to operate as a pump for liquids, as a gas compressor or as a motor to be driven by pressurised liquid, gas or vapour.

According to another aspect of the present invention there is provided a radial rotary internal combustion engine including a stator a first surface formed on the stator as a surface of revolution about a first axis, a rotor, a second surface formed on part of the rotor as a surface of revolution about the first axis, the first and second surfaces being mounted for relative sliding rotation therebetween characterised by a plurality of working cylinders formed in or on the rotor substantially radial to the first axis and spaced evenly circumferentially, a piston slidable axially in each cylinder and being a sliding fit therein, a drive shaft formed with a crank throw and a crank pin thereon, connecting rods connecting each piston to the same crank pin or each to a separate one of a plurality of coaxial crank pins, for each cylinder there being a port formed in the stator through said first surface, at a predetermined circumferential location in the stator, through which port fluid may pass to or from the cylinder, each said port being exposed to one only of said cylinders during rotation thereof, and drive means interconnecting the rotor and the drive shaft, the drive means being arranged to rotate the rotor and the drive shaft relative to the stator at predetermined speeds and directions of rotation.

Preferably, the planes of rotation of the cylinder axes are spaced along the drive shaft. For each cylinder there is conveniently a separate inlet port, exhaust port, spark plug and/or fuel injector, as required.

BRIEF DESCRIPTION OF THE DRAWINGS

Various embodiments are described, by way of example only, with reference to the accompanying drawings, which are diagrammatic only, and in which.

DESCRIPTION

Figure 1:
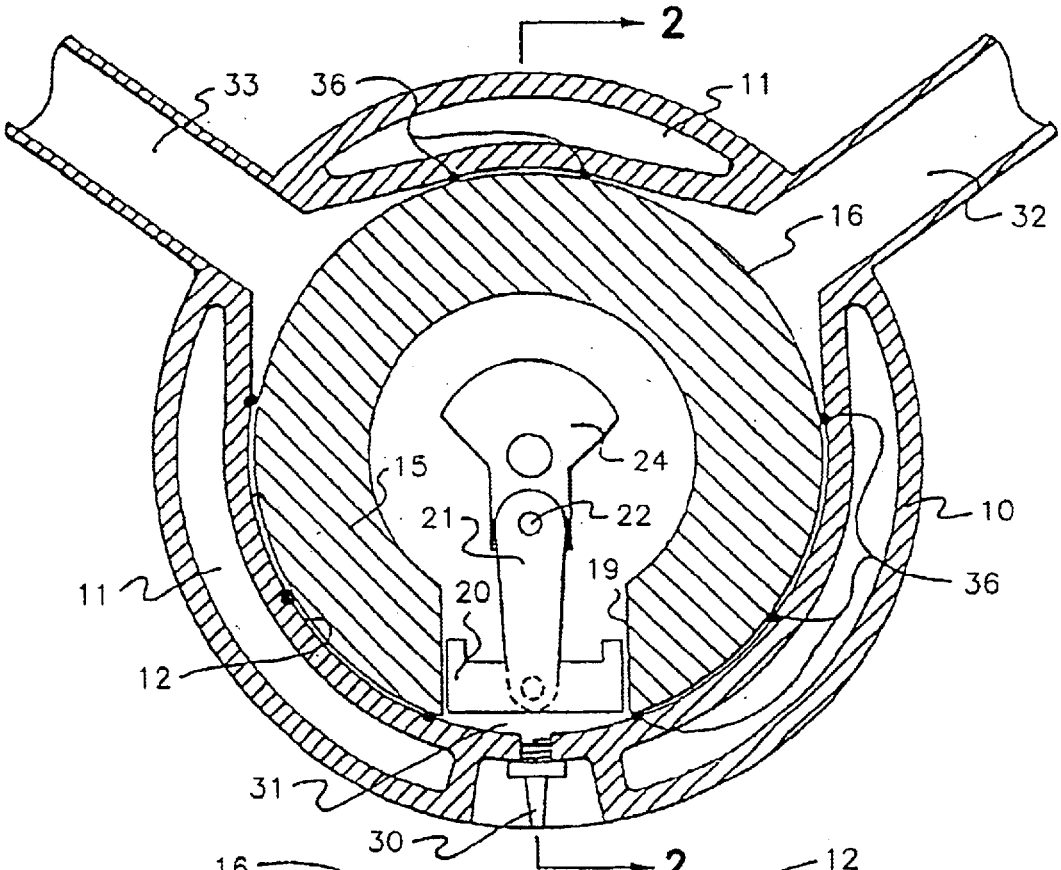
FIG. 1 is a section in a transverse plane of an internal combustion engine, according to the invention.
Figure 2:
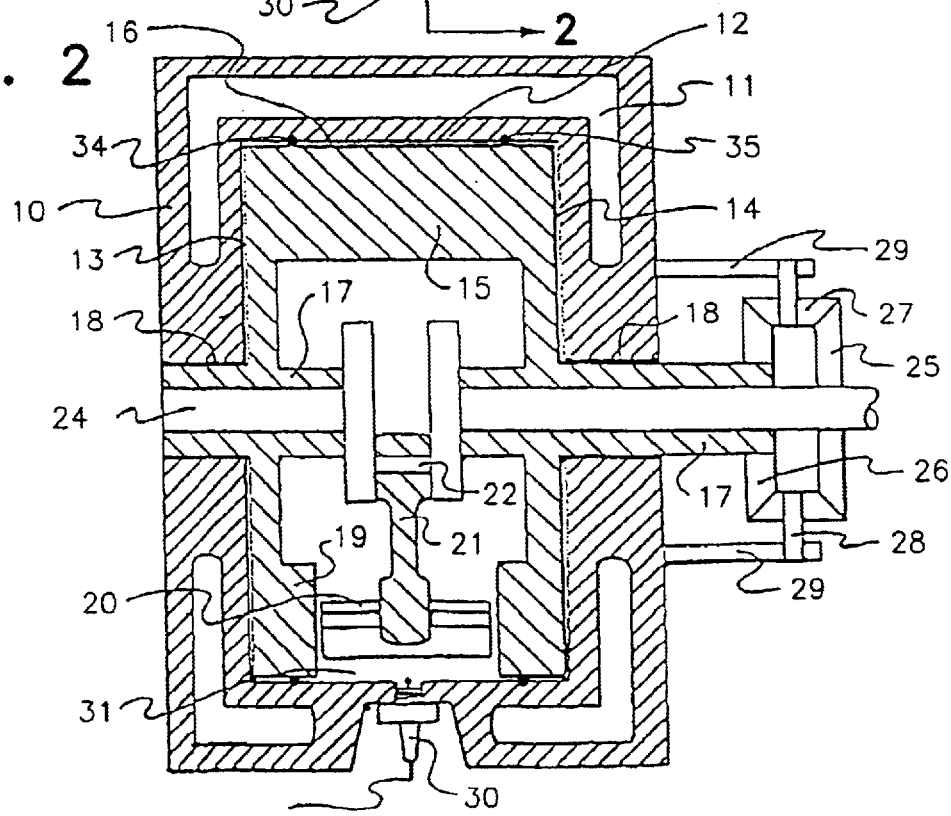
FIG. 2 is a section along the line II—II in FIG. 1.
Figure 3:
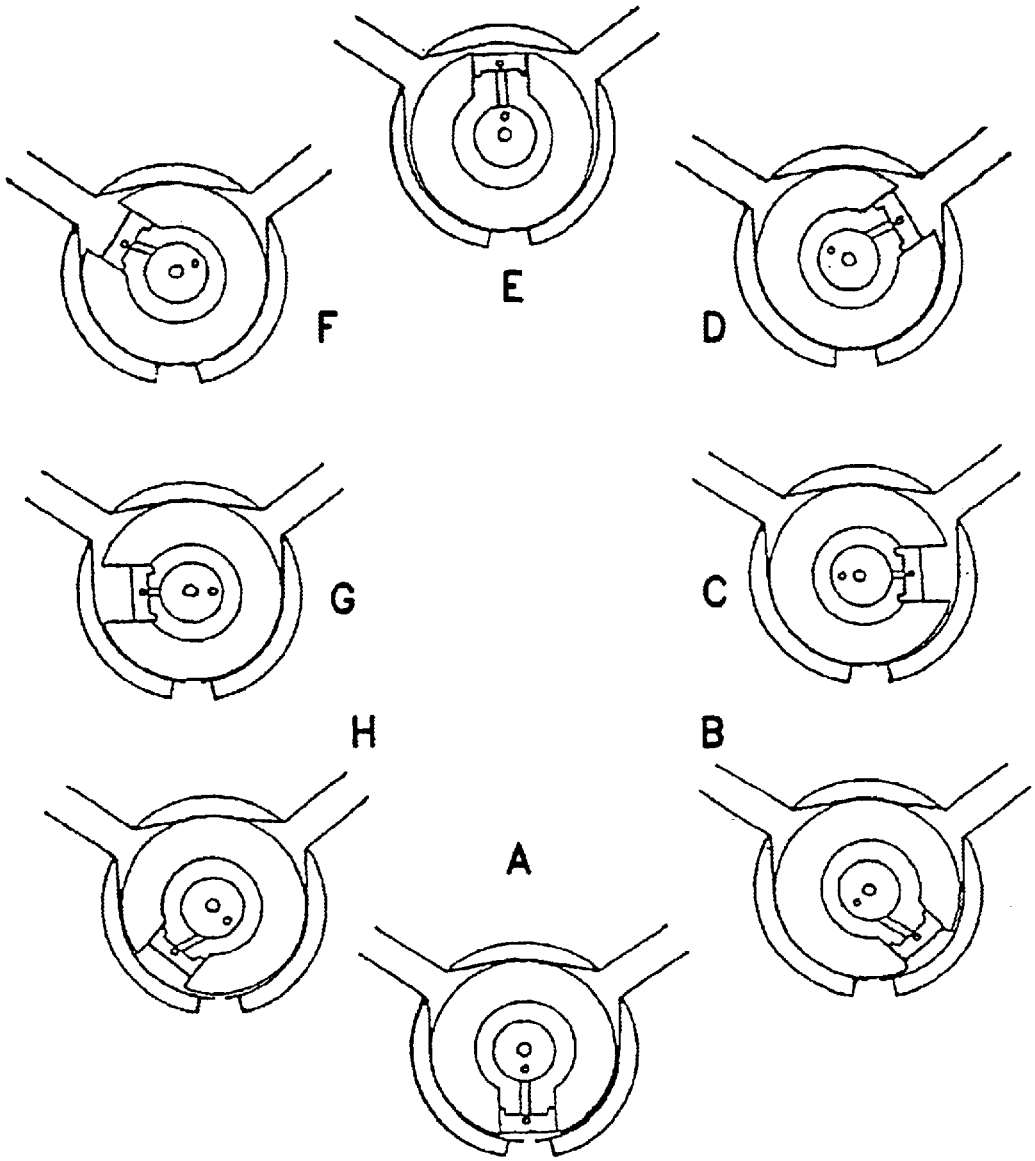
FIG. 3 shows various phases of operation of the engine shown in FIG. 1, at reduced scale.

In FIGS. 1 to 3 a four-stroke single cylinder internal combustion engine includes a stator 10 having cooling water passages 11. The stator 10 is formed with a smooth surface in the form of a right cylinder 12 and with flat radial faces 13, 14. A rotor 15 is contained within the space bounded by the surfaces 12, 13, 14. The rotor 15 has an external surface 16, which is generally in the form of a right cylinder and is a smooth sliding fit within the surface 12 of the stator 10. The rotor 15 has internally and externally projecting sleeves 17, coaxial with the surface 16. The sleeves 17 are rotatable in bearings 18 in the stator 10, whereby the rotor 15 may be rotated within the stator 10.

Within the rotor 15, there is formed a substantially radial cylinder 19 in which an engine piston 20 is reciprocable. The piston 20 is joined by a connecting rod 21 to a throw 22 of a crankshaft 24, the crankshaft 24 runs in bearings (unshown) within the sleeves 17 of the rotor 15. At the right-hand side of FIG. 2, the crankshaft 24 and one of the sleeves 17 protrude outside the stator 10 and each have affixed thereon a bevel gear 25, 26 interconnected by idler bevel gears 27 pivoted on pins 28 carried on protruding parts 29 of the stator 10. In most embodiments of the engine, the gears 25, 26 are of the same size.

In normal use, power from the engine is taken from the right-hand end of the crankshaft 24, but it could be taken from one of the bevel gears 27, for which purpose they would be affixed to a suitable power output shaft instead of running free on one of the pins 28. It will be seen that, by virtue of the bevel gears 25, 26, 27, when the crankshaft 24 is rotated in one direction within the stator 10, the rotor 15 will be rotated through the same angle but in the opposite direction within the stator 10.

At the bottom of FIGS. 1 and 2 there is shown a spark plug 30 fastened through the walls of the stator 10 into a combustion space 31 formed between the head of the piston 20 and the surface 12 of the stator 10.

Also shown in FIGS. 1 and 3 are an exhaust port 32 and an inlet port 33, formed through the stator 10 and extending towards the surface 16 of the rotor 15.

FIG. 3 shows various phases of the mode of operation of the engine described so far, FIG. 3*a* corresponding to FIG. 1.

Starting with FIG. 3*a*, the piston 20 is at its "top dead centre". Assume initially that the combustion space 31 contains a compressed charge of ignitable air/fuel mixture, which is then ignited by the spark plug 30 to start a power stroke.

With the rotor 15 rotating anti-clockwise, and the crankshaft 24 rotating clockwise, therefore, FIG. 3*b* shows the situation when they both rotated through 45 degrees from FIG. 3*a*, the piston 20 then being approximately half-way down its power stroke.

In FIG. 3*c* the crankshaft 24 and rotor 15 have both rotated through 90 degrees, relative to the stator 10, so that the piston 20 is at "bottom dead centre" at the end of the power stroke. At that point, the open end of the cylinder 19 has become vented to the exhaust port 32 so that the products of combustion within the working cylinder may escape therefrom.

FIG. 3*d* shows the crankshaft 24 and the rotor 15 rotated through a further 45 degrees during the exhaust stroke of the four-stroke cycle, the piston 20 then being approximately halfway up the cylinder 19 again.

FIG. 3*e* shows the piston 20 again at its "top dead centre" but in this case the open end of the cylinder 19 is exposed to the exhaust port 32 and inlet port 33 at the same time, to provide the normal valve overlap which is used with four-stoke cycle engines.

FIG. 3*f* shows the engine half-way through the induction stroke, the piston 20 being half-way down the cylinder 19 again, and the cylinder 19 being fully exposed to the inlet port 33.

FIG. 3*g* shows the end of the induction stroke, the piston 20 being at "bottom dead centre" again.

FIG. 3*h* shows the rotor 15 and crankshaft 24 rotated through a further 45 degrees, when the piston 20 is approximately half-way up the cylinder 19, compressing the air/fuel mixture previously drawn into the engine. A further 45 degree rotation of both components, again in opposite directions, brings the piston 20 to its normal "top dead centre" position ready for ignition and a repeat of the four-stroke cycle.

To prevent the leakage of gas to and from the engine, a seal is provided between the rotor 15 and stator 10 in the form of two circumferential sealing rings 34 and 35, preferably located in grooves in the surface 12 of the stator 10 and located either side of the cylinder 19. Further sealing is provided by sealing strips 36, extending at least between the rings 34, 35 and positioned at strategic circumferentially spaced locations around the surface 12 of the stator 10, for example, at either side of the inlet port 33, the exhaust port 32, the cylinder 19 when it is lined up with spark plug 30, and elsewhere, as required.

It will be seen that this four-stroke cycle engine produces one power stroke for each revolution of the crankshaft 24, rather that the usual power stroke for each two revolutions of the crankshaft in a conventional engine.

If the engine shown in the drawings is to run on the two-stroke cycle, it will be necessary to provide another spark plug 30 diametrically opposite the one shown in FIGS. 1 and 2.

Furthermore, further inlet and exhaust porting will be required. Such porting will be familiar to those versed in the art of internal combustion design. By use of fuel injectors in place of the spark plug 30, the engine could run on the diesel cycle.

If more power is required, two, three or more of the cylinders 19 may be provided, preferably evenly spaced around the rotor 15. Each cylinder 19 will have its co-acting piston 20 and connecting rod 21, all of the connecting rods 21 being pivoted effectively to the crank pin 22. This may be achieved by using one "master" connecting rod, to which the other connecting rods are pivoted, as is well known in non-rotary, radial engines.

Instead of the bevel gear train 25, 26, 27, the reverse drive between the rotor 15 and crankshaft 24 can be provided by a suitable spur gear train or by any, other suitable drive means. Although the invention has been described as applied to two-stroke and four-stroke internal combustion engines, it can be used as a pump for liquids, as a gas compressor or as a motor operated by pressurised liquid, gas or vapour, if appropriate inlet and exhaust port arrangements are provided.

In the engines described so far, the torque generated on the crankshaft 24 will be equalled by the reaction torque generated on the rotor 15 and since they both operate at the same speed (although in opposite directions) the same power will flow out through the crankshaft 24 as through the sleeve 17 of the rotor 15.

However, if all the power is to be taken from the crankshaft 24, the power from the rotor 15 will be passed to the crankshaft 24 by virtue of the bevel gear train 25, 26, 27.

Figures 4, 5:
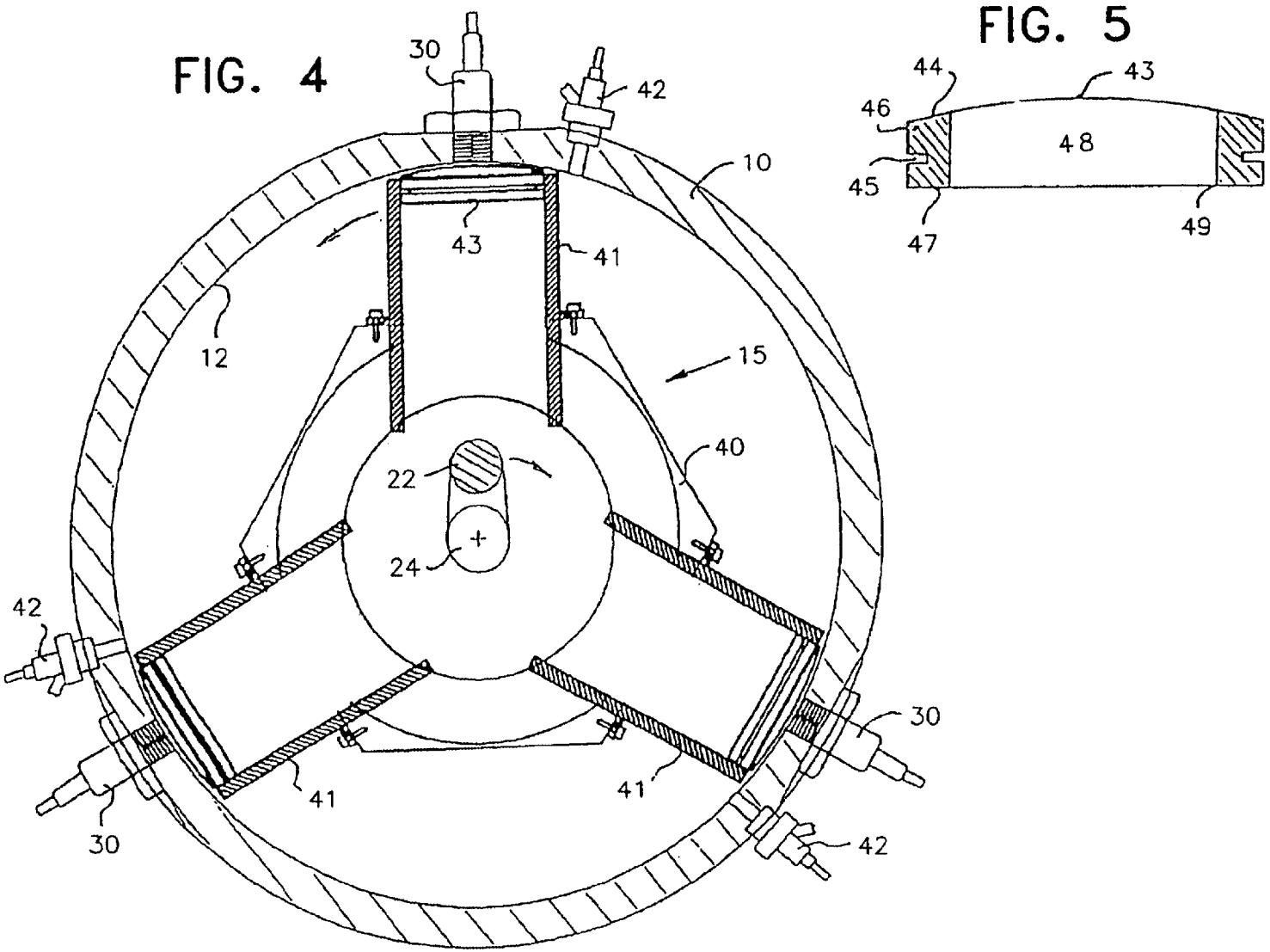
FIG. 4 is a diagrammatic section in a transverse plane of part of a 3-cylinder version of the engine shown in FIG. 1.
FIG. 5 is a section at enlarged scale of part of the engine shown in FIG. 4.

FIG. 4 shows a 3-cylinder version of the engine shown in FIGS. 1 and 2. In FIG. 4, the pistons 20 and connecting rods 21 are omitted, but the rods 21 run on the pin 22 of the crankshaft 24. As mentioned above, one of the rods 21 can be a master rod, to which the other rods are articulated.

In this design the rotor 15 is a hexagonal block 40 to which three cylinders 41 are fastened, to protrude radially towards the surface 12 of the stator 10. Three spark plugs 30 are circumferentially spaced around the stator 10, so as to be exposed to the interior of each cylinder 41, as the piston therein reaches top dead centre at the end of the compression stroke.

Before each cylinder 41 reaches its spark plug 30, it passes a fuel injector 42. These are positioned circumferentially such that they are outside the cylinders 41 when the spark plug 30 ignites the mixture. Thus, the injectors 42 are not subject to the combustion pressures or flame temperatures obtaining in the cylinder 41. On the other hand, the injectors 42 can inject fuel direct into the air in the cylinders 41 leading to improved fuel vaporisation, cooling of the pistons and of the air charge, and to the option of a exploiting stratified charge effects.

Each spark plug 30 and injector 42 has its own related air inlet port and exhaust port, to be passed by all the cylinders 41 in turn. To avoid interference by the inlet port and exhaust port of one cylinder 41 with the operation of another cylinder 41, the inlet ports and exhaust ports are circumferentially short.

FIG. 5 shows, at enlarged scale, a sealing ring 43 which is a close sliding fit in the outer part of each cylinder 41. The outer surface 44 of the ring 43 is ground to match and seal against the surface 12 and to be able to slide along it. The ring 43 is sealed within the cylinder 41 by a piston ring in a groove 45. In use, centrifugal force presses the ring 43 against the surface 12. The ring 43 is prevented from falling down the cylinder 41 by a thin springy ring in another groove 46 which bears against the end of the cylinder 41 and also exerts a small force on the ring 43 radially outwards of the engine, to enable compression during start up.

At top dead centre, the top of the piston 20 is very close to the bottom face 47 of the ring 43. Thus the combustion chamber is formed by the space 48 in the centre of the ring 43 or partly in the space 48 and partly in the piston crown if preferred. This gives a desirably compact combustion chamber and the option to change compression ratios by changing the ring 43 to one with a different space 48. The small space between the top of the piston 20 and the face 47 gives a good "squish" area for improved combustion. The corner 49 can be rounded, even locally, if required. Since combustion pressure acts on the face 47, the surface area of the opposite end face 44 of the ring 43 can be selected to improve sealing against the surface 12, if necessary.

Figure 6:
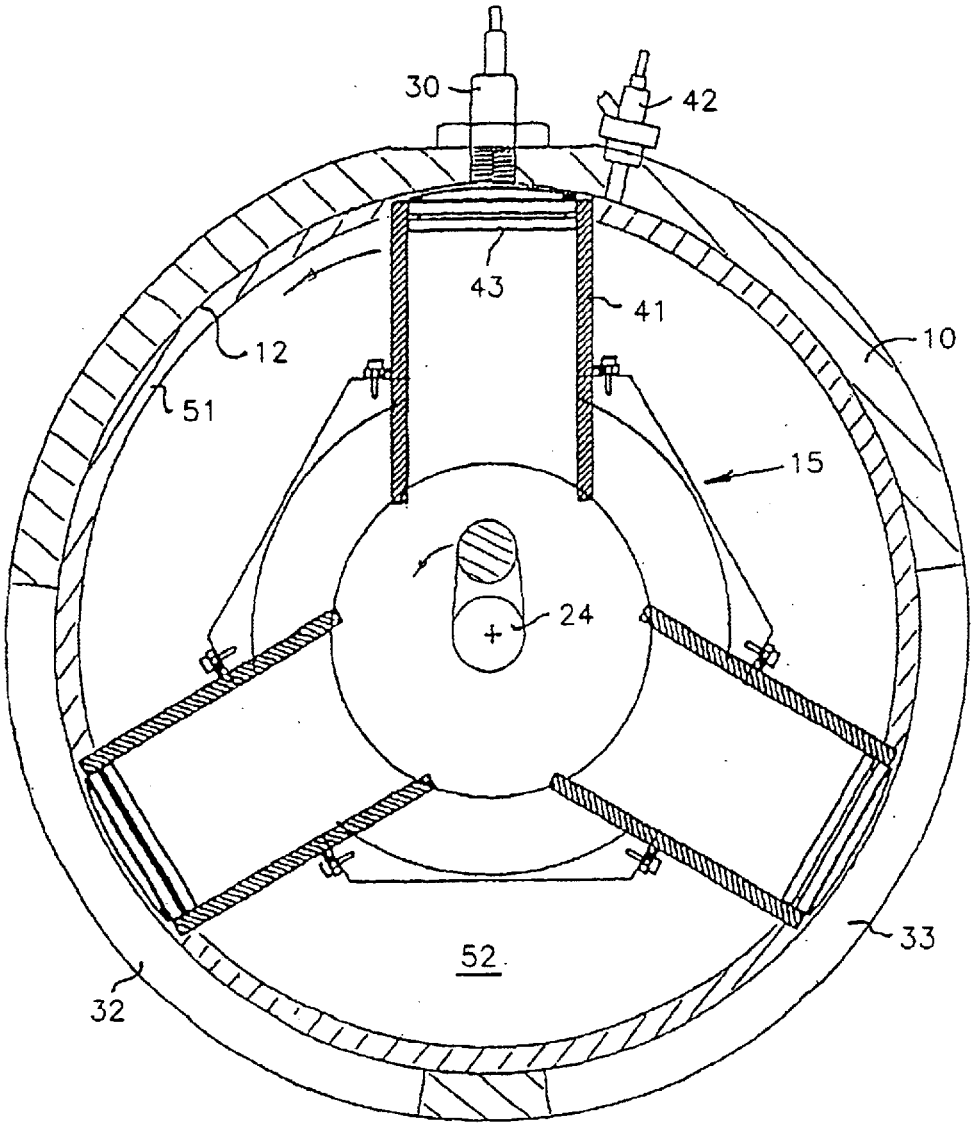
FIG. 6 shows an alternative engine design to FIG. 4.

FIG. 6 shows an engine, which in most respects is identical to FIG. 4. However, in FIG. 6, the crankshaft 24 and the rotor 15 rotate in the same direction. The gearing interconnecting the crankshaft 24, the stator 10 and the rotor 15 is chosen so that the crankshaft 24 rotates three revolutions for every revolution of the rotor 15.

In this embodiment, the pistons of each cylinder reach their top dead centre at the end of their compression stroke, at the same circumferential position of the stator 10. Thus, only one spark plug 30 and injector 42 is needed. Furthermore, the inlet port 33 and exhaust port 32 can extend around 90 degrees of circumference each, to ensure full charging of air in each cylinder 41 during the induction stroke, and full scavenging of products of combustion from the cylinder 41 during the exhaust stroke.

In FIG. 6 a cylindrical baffle 51 is shown extending between adjacent cylinders 41 and being a close sliding fit adjacent the surface 12 of the stator 10. The baffle 51 serves to prevent exhaust gas, when the cylinder 41 starts to pass the exhaust port 32, from escaping therefrom into the space 52 between the cylinders 41.

Figure 7:
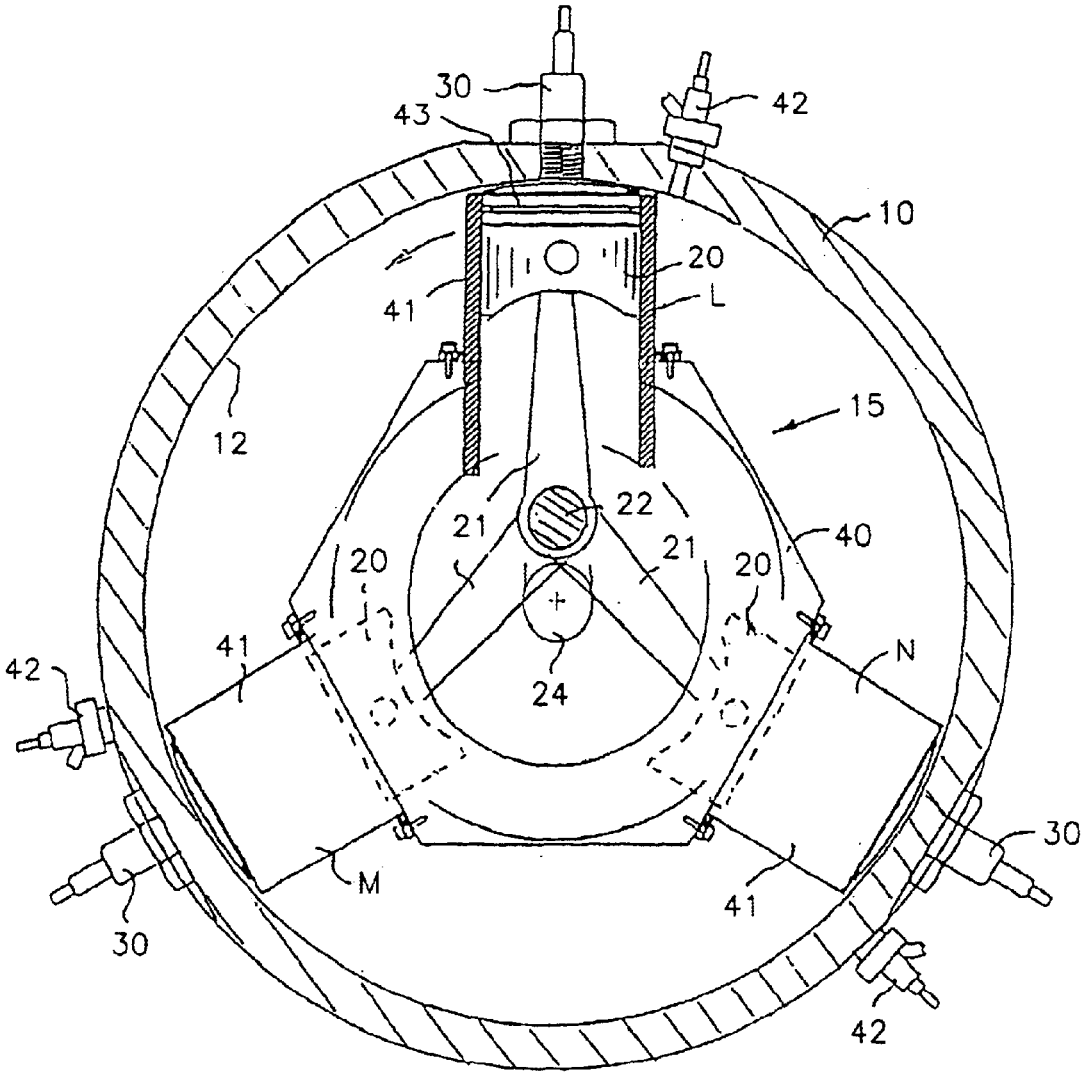
FIG. 7 shows an alternative engine design to FIGS. 4 and 6.

The embodiment shown in FIG. 7 is very similar to that shown in FIG. 4. However, in FIG. 7, the longitudinal central axes of the three cylinders L, M and N are spaced apart along the crankshaft 24 by distances approximately equal to the bore of each cylinder 41. Thus, the area of the interior surface 12 swept by any one of the cylinders L, M or N is not swept by the other cylinder.

It will be seen that all three connecting rods 21 run on a single pin 22 of the crankshaft 24. The rods 21 may be spaced along the pin 22 by intermediate spacers. If preferred, intermediate main bearings may be provided between connecting rods 21, the crankshaft 24 then having three co-axial crank pins 22.

In the embodiment shown in FIG. 7, the ring 43 is used in each cylinder, as described with reference to FIGS. 4 and 5.

Since there is substantially no overlap of the paths swept by the cylinders L, M and N on the surface 12, each cylinder L, M and N can have inlet and exhaust ports through the stator 10 as long or short circumferentially as required.

The operating modes of each cylinder L, M and N relative to the angle of rotation of the crankshaft 24 is shown in the following table:

| Crank Angle | Cylinder L | Cylinder M | Cylinder N |
|---|---|---|---|
| 0 | TDC Ignition | Exhaust Stroke | Inlet Stroke |
| 30 | | | BDC |
| 60 | Power Stroke | 60 Degrees TDC | Compression Stroke |
| 90 | 270 Degrees BDC | Inlet Stroke | |
| 120 | Exhaust Stroke | | 120 Degrees TDC Ignition |
| 150 | | 330 Degrees BDC | Power |
| 180 | 180 Degrees TDC | Compression Stroke | Stroke |
| 210 | Inlet Stroke | | 30 Degrees BDC |
| 240 | | 240 Degrees TDC Ignition | Exhaust Stroke |
| 270 | 90 Degrees BDC | | |
| 300 | Compression Stroke | Power Stroke | 300 Degrees TDC |
| 330 | | 150 Degrees BDC | Inlet Stroke |
| 360 | 0 Degrees TDC | Exhaust Stroke | |

Although the engine has been described in single cylinder and in three cylinder forms, by appropriate selection of relative speeds and directions of rotation of the crankshaft 24 and the rotor 15, other numbers of cylinders can be used. For example and engine having five radial cylinders has been found to be satisfactory.

What is claimed is:

1. A rotary fluid pressure machine comprising a stator, a first surface formed on an interior surface of the stator as a surface of revolution about a first axis, a rotor, a second surface formed on part of the rotor as a surface of revolution about the first axis, the first and second surfaces being mounted for relative sliding rotation, a cylinder formed in the rotor and extending substantially radial to the first axis, a piston slidable axially in the cylinder and being in a sliding fit therein, a crank shaft, coupling means interconnecting the piston and the crank shaft, the coupling means causing reciprocation of the piston in the cylinder to rotate the crank shaft or rotation of the crank shaft to cause reciprocation of the piston in the cylinder, a port formed in the stator extending through said first surface at a predetermined circumferential location in the stator, fluid passing to or from the cylinder through said port, drive means interconnecting the rotor and the crank shaft, the drive means being arranged to rotate the rotor and the crank shaft relative to the stator at predetermined speeds and directions of rotation, and a plurality of said cylinders and said pistons being disposed along a length of the crank shaft such that, in use, an area of said first surface swept by each one of said plurality of cylinders is different from an area of said first surface swept by any other of said plurality of cylinders.

2. The machine as claimed in claim 1, wherein the coupling means comprises a connecting rod pivotally mounted on the piston and a pin of the crank.

3. The machine as claimed in claim 1, wherein the stator is external of the rotor.

4. The machine as claimed in claim 1, wherein said first and second surfaces are right cylinders co-axial about said first axis.

5. The machine as claimed in claim 1, wherein first and second ones of said ports for each of said cylinders respectively admits and expels fluid to and from said cylinder.

6. The machine as claimed in claim 1, wherein for each of said cylinders a first and second of said ports are spaced circumferentially around the stator, one port being adapted to admit air or an air/fuel mixture to the cylinder and the other port being an exhaust port from the cylinder.

7. The machine as claimed in claim 6, wherein a separate spark plug and fuel injector are held in the stator for each of said cylinders and exposed to said cylinder at a predetermined circumferential position of the rotor.

8. The machine as claimed in claim 6, wherein operating on a two stroke or a four-stroke cycle, said drive means is arranged to rotate the crank shaft at a speed relative to the stator equal to a speed of rotation of the rotor relative to the stator, with the crank shaft and rotor rotating in opposite directions relative to the stator.

9. The machine as claimed in claim 8, wherein the drive means interconnecting the rotor and the crank shaft includes a toothed gear train adapted to drive the crank shaft and the rotor relative to the stator at a same rotational speed but in opposite directions.

10. The machine as claimed in claim 6, wherein a sealing between the rotor and the stator is provided by a pair of second circumferential sealing rings located in grooves in the rotor or the stator, the rings being on opposite sides axially of the cylinder.

11. The machine as claimed in claim 10, wherein further sealing is provided by a plurality of sealing strips located within said first surface to bear against the second surface and spaced circumferentially, each strip extending from one of said sealing rings to the other.

12. The machine as claimed in claim 6, wherein said plurality of said cylinders and said co- acting pistons are disposed circumferentially around the rotor.

13. The machine as claimed in claim 1, further comprising one of a pump for liquids, a gas compressor and a motor to be driven by pressurized liquid, gas or vapor.

14. A rotary internal combustion engine comprising a stator, a first surface formed on an interior surface of the stator as a surface of revolution about a first axis, a rotor, a second surface formed on part of the rotor as a surface of revolution about the first axis, the first and second surfaces being mounted for relative sliding rotation, a plurality of cylinders formed in or on the rotor and extending substantially radial to the first axis and spaced evenly circumferentially, a piston slidable axially in each cylinder and being in a sliding fit therein, a crank shaft formed with a crank throw and a crank pin thereon, connecting rods connecting each piston to a same crank pin or each to a separate one of a plurality of coaxial crank pins, for each cylinder there being a port formed in the stator extending through said first surface, at a predetermined circumferential location in the stator, through which port fluid passes to or from the cylinder, each said port being exposed to only one of said cylinders during rotation thereof, drive means interconnecting the rotor and the crank shaft, the drive means being arranged to rotate the rotor and the crank shaft relative to the stator at predetermined speeds and directions of rotation, and a plurality of said cylinders and said pistons being disposed along a length of the crank shaft such that, in use, an area of said first surface swept by each one of said plurality of cylinders is different from an area of said first surface swept by any other of said plurality of said cylinders.

15. The engine as claimed in claim 14, wherein for each cylinder there is a separate inlet port, exhaust port, spark plug and fuel injector.

16. The machine as claimed in claim 1, wherein sealing between each of said cylinders and said stator is provided by a sealing ring slideably engaged with an interior of the cylinder.

17. The machine as claimed in claim 16, wherein, in use, said sealing ring is pressed against said first surface by centrifugal force.

18. The engine as claimed in claim 14, wherein sealing between each of said cylinders and said stator is provided by a sealing ring slideably engaged with an interior of the cylinder.

19. The engine as claimed in claim 18, wherein in use, said sealing ring is pressed against said first surface by centrifugal force.

20. The engine as claimed in claim 19, wherein the sealing ring is prevented from falling down the cylinder during startup.

21. The engine as claimed in claim 20, wherein a combustion chamber of the cylinder is provided by a space in a center of the sealing ring.

22. The engine as claimed in claim 21, wherein a squish area is formed between the piston and said sealing ring.

23. The engine as claimed in claim 14, wherein each of said plurality of cylinders produces one power stroke for each revolution of said crank shaft.

24. The engine as claimed in claim 23, wherein the engine operates on a four stroke cycle.

* * * * *